US007524051B2

(12) United States Patent
Ahne et al.

(10) Patent No.: US 7,524,051 B2
(45) Date of Patent: Apr. 28, 2009

(54) HAND-OPERATED PRINTER HAVING A USER INTERFACE

(75) Inventors: Adam Jude Ahne, Lexington, KY (US); Miles Edward Anderson, Georgetown, KY (US); Edmund Hulin James, III, Lexington, KY (US); Michael Kelley Webb, Winchester, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 326 days.

(21) Appl. No.: 11/312,154

(22) Filed: Dec. 20, 2005

(65) Prior Publication Data

US 2007/0139507 A1 Jun. 21, 2007

(51) Int. Cl.
*B41J 3/36* (2006.01)
*B41J 29/13* (2006.01)

(52) U.S. Cl. ..... 347/109; 347/108

(58) Field of Classification Search ..... 347/109, 347/108; 346/143; 400/88
See application file for complete search history.

(56) References Cited

U.S. PATENT DOCUMENTS 4,675,700 A 6/1987 Nagira et al.
4,758,849 A 7/1988 Piatt et al.
4,804,949 A 2/1989 Faulkerson ..... 340/710
4,819,083 A 4/1989 Kawai et al. ..... 358/294
4,906,843 A 3/1990 Jones et al. ..... 250/221
4,915,027 A 4/1990 Ishibashi et al.
4,933,867 A 6/1990 Ishigaki
4,947,262 A 8/1990 Yajima et al.
4,949,391 A 8/1990 Faulkerson et al.
4,999,016 A 3/1991 Suzuki et al.
5,013,895 A 5/1991 Iggulden et al.
5,024,541 A 6/1991 Tsukada et al.
5,028,934 A 7/1991 Kasai et al.
5,052,832 A 10/1991 Akiyama et al.
5,063,451 A 11/1991 Yanagisawa et al.
5,093,675 A 3/1992 Koumura et al.
5,110,226 A 5/1992 Sherman et al.
5,111,216 A 5/1992 Richardson et al.
5,149,980 A 9/1992 Ertel et al.
5,160,943 A 11/1992 Pettigrew et al.
5,184,907 A 2/1993 Hamada et al.
5,186,558 A 2/1993 Sherman et al.
5,188,464 A 2/1993 Aaron
5,236,265 A 8/1993 Saito et al.
5,240,334 A 8/1993 Epstein et al.
5,262,804 A 11/1993 Petigrew et al.
5,267,800 A 12/1993 Petteruti et al.
5,308,173 A 5/1994 Amano et al.
5,311,208 A 5/1994 Burger et al.
5,312,196 A 5/1994 Hock et al.

(Continued)

*Primary Examiner*—Manish S Shah
*Assistant Examiner*—Leonard S Liang
(74) *Attorney, Agent, or Firm*—Taylor & Aust, PC

(57) ABSTRACT

A hand-operated printer includes a body, a printhead mounted to the body, a target sight mounted to the body, and a display device mounted to the body. The display device is configured to display an image and a representation of the target sight in relation to the image, and wherein the relation between the representation of the target sight and the image that are displayed on the display device corresponds to a relationship between the target sight and a print position for the image.

20 Claims, 6 Drawing Sheets

U.S. PATENT DOCUMENTS 5,344,248 A 9/1994 Schoon et al.
5,355,146 A 10/1994 Chiu et al.
5,446,559 A 8/1995 Birk
5,449,238 A 9/1995 Pham et al.
5,462,375 A 10/1995 Isobe et al.
5,475,403 A 12/1995 Havlovick et al.
5,503,483 A 4/1996 Petteruti et al.
5,520,470 A 5/1996 Willett
5,578,813 A 11/1996 Allen et al.
5,650,820 A 7/1997 Sekine et al.
5,664,139 A 9/1997 Spurlock
5,685,651 A 11/1997 Hayman et al.
5,686,720 A 11/1997 Tullis
5,729,008 A 3/1998 Blalock et al.
5,786,804 A 7/1998 Gordon
5,806,993 A 9/1998 Petterutti et al.
5,816,718 A 10/1998 Poole
5,825,044 A 10/1998 Allen et al.
5,825,995 A * 10/1998 Wiklof et al. ..... 358/1.18
5,829,893 A 11/1998 Kinoshita et al.
5,842,793 A 12/1998 Katayama et al.
5,848,849 A 12/1998 Kishi et al.
5,850,243 A 12/1998 Kinoshita et al.
5,853,251 A 12/1998 Imai
5,887,992 A 3/1999 Yamanashi
5,892,523 A 4/1999 Tanaka et al.
5,927,827 A 7/1999 Reuter et al.
5,927,872 A * 7/1999 Yamada ..... 400/88
5,953,497 A 9/1999 Kokubo et al.
5,984,455 A 11/1999 Anderson
5,986,769 A * 11/1999 Krzyminski ..... 356/445
5,988,900 A 11/1999 Bobry ..... 400/88
5,997,193 A 12/1999 Petterutti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,026,686 A 2/2000 Hattori et al.
6,076,910 A 6/2000 Anderson
6,158,907 A 12/2000 Silverbrook et al.
6,195,475 B1 2/2001 Beausoleil, Jr. et al.
6,203,221 B1 3/2001 Tomasik et al.
6,229,565 B1 * 5/2001 Bobry ..... 348/207.99
6,246,423 B1 6/2001 Suzuki et al.
6,249,360 B1 6/2001 Pollard et al.
6,259,826 B1 7/2001 Pollard et al.
6,270,187 B1 8/2001 Murcia et al.
6,270,271 B1 8/2001 Fujiwara
6,305,770 B1 * 10/2001 Silverbrook ..... 347/2
6,312,124 B1 * 11/2001 Desormeaux ..... 347/109
6,338,555 B1 1/2002 Hirose
6,347,897 B2 2/2002 Huggins et al.
6,357,939 B1 3/2002 Baron
6,373,995 B1 4/2002 Mioore
6,394,674 B2 5/2002 Huggins et al.
6,499,840 B2 12/2002 Day et al. ..... 347/100
6,503,005 B1 1/2003 Cockerill et al.
6,533,476 B2 3/2003 Hamisch, Jr. et al.
6,543,893 B2 4/2003 Desormeaux ..... 347/109
6,549,304 B1 * 4/2003 Dow et al. ..... 358/473
6,553,459 B1 4/2003 Silverbrook et al.
6,572,290 B2 6/2003 McCleave et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,597 B2 9/2003 Fujiwara
6,641,313 B2 11/2003 Bobry
6,648,528 B2 11/2003 Hardisty et al.
6,652,090 B2 11/2003 Silverbrook
6,674,543 B2 1/2004 Day et al. ..... 358/1.8
6,769,360 B2 8/2004 Walling
6,773,177 B2 * 8/2004 Denoue et al. ..... 400/88
6,846,119 B2 1/2005 Walling
6,942,335 B2 9/2005 Trent ..... 347/109
6,952,880 B2 10/2005 Saksa ..... 33/35
2001/0019349 A1 9/2001 Kawakami
2001/0022914 A1 9/2001 Iura et al.
2001/0024586 A1 9/2001 Day et al.
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2003/0031494 A1 2/2003 Cockerill et al.
2003/0063938 A1 4/2003 Hardisty et al.
2003/0117456 A1 6/2003 Silverbrook et al.
2004/0009024 A1 1/2004 Hardisty et al.
2004/0014468 A1 1/2004 Walling
2004/0018035 A1 1/2004 Petteruti et al.
2005/0018032 A1 1/2005 Walling
2005/0018033 A1 1/2005 Walling
2006/0012660 A1 1/2006 Dagborn
2006/0050131 A1 3/2006 Breton
2006/0061647 A1 3/2006 Breton
2006/0165460 A1 7/2006 Breton
2007/0109339 A1 * 5/2007 Ahne et al. ..... 347/19

* cited by examiner

HAND-OPERATED PRINTER HAVING A USER INTERFACE

BACKGROUND OF THE INVENTION

1. Field of the Invention

The present invention relates to a hand-operated printer, and, more particularly, to a hand-operated printer having a user interface.

2. Description of the Related Art

A hand-operated printer, also sometimes referred to as a hand held printer, is a printer that typically does not include a drive mechanism for positioning a printhead relative to the print medium, such as paper. An optical encoder typically is used to provide position feedback of relative motion between the hand-operated printer and the print medium. In such printers, it may be difficult for a user to accurately position the printed image at the desired position in relation to the print medium.

SUMMARY OF THE INVENTION

The invention, in one exemplary embodiment, is directed to a hand-operated printer. The hand-operated printer includes a body, a printhead mounted to the body, a target sight mounted to the body, and a display device mounted to the body. The display device is configured to display an image and a representation of the target sight in relation to the image, and wherein the relation between the representation of the target sight and the image that are displayed on the display device corresponds to a relationship between the target sight and a print position for the image.

The invention, in another exemplary embodiment, is directed to a hand-operated printer including a body, a printhead mounted to the body, a position encoder mounted to the body, a target sight mounted to the body, a memory device mounted to the body, and a user interface mounted to the body. The memory device has stored thereon a plurality of images. The user interface includes a display device and a plurality of control buttons. The display device is configured to display an image of the plurality of images and is configured to display a representation of the target sight in relation to the image. A controller is communicatively coupled to each of the printhead, the position encoder, the memory device and the user interface. The controller executes program instructions for retrieving the image from the memory device, and displaying the image on the display device, wherein the relation between the representation of the target sight and the image that are displayed on the display device corresponds to a relationship between the target sight and a print position for the image on a print medium.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
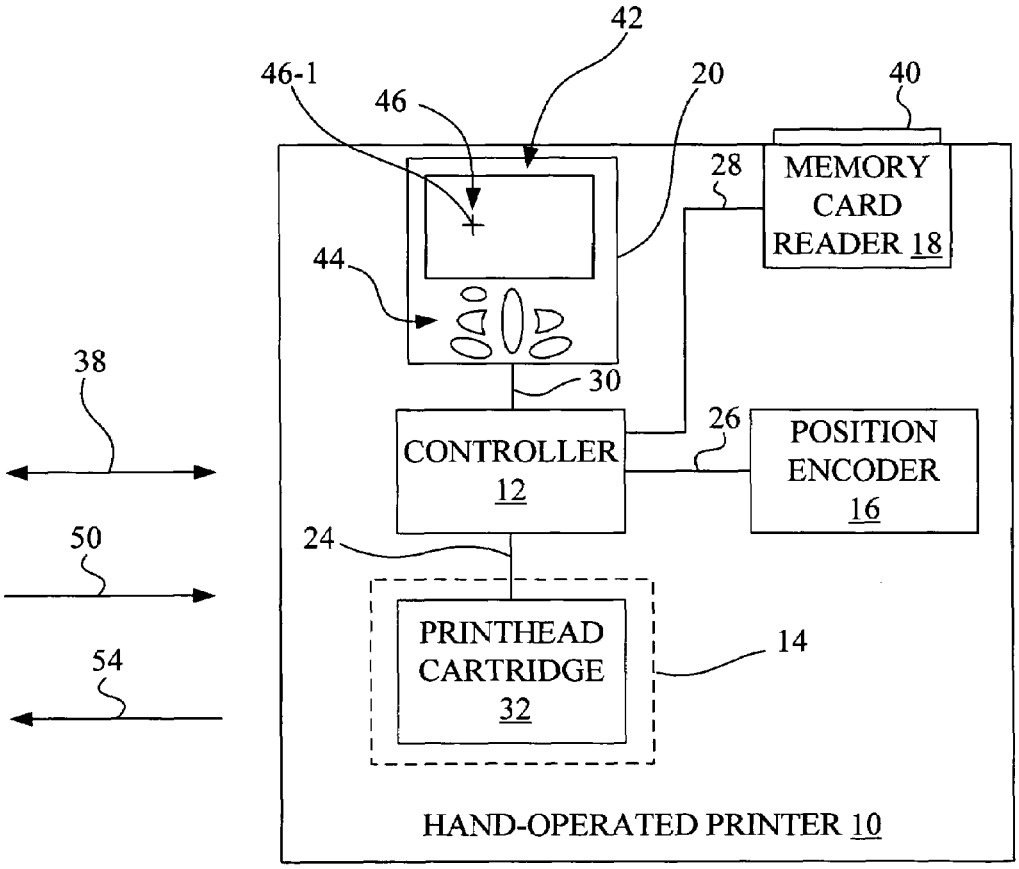
FIG. 1 is a general diagrammatic representation of a hand-operated printer in accordance with an embodiment of the present invention.
Figure 2:
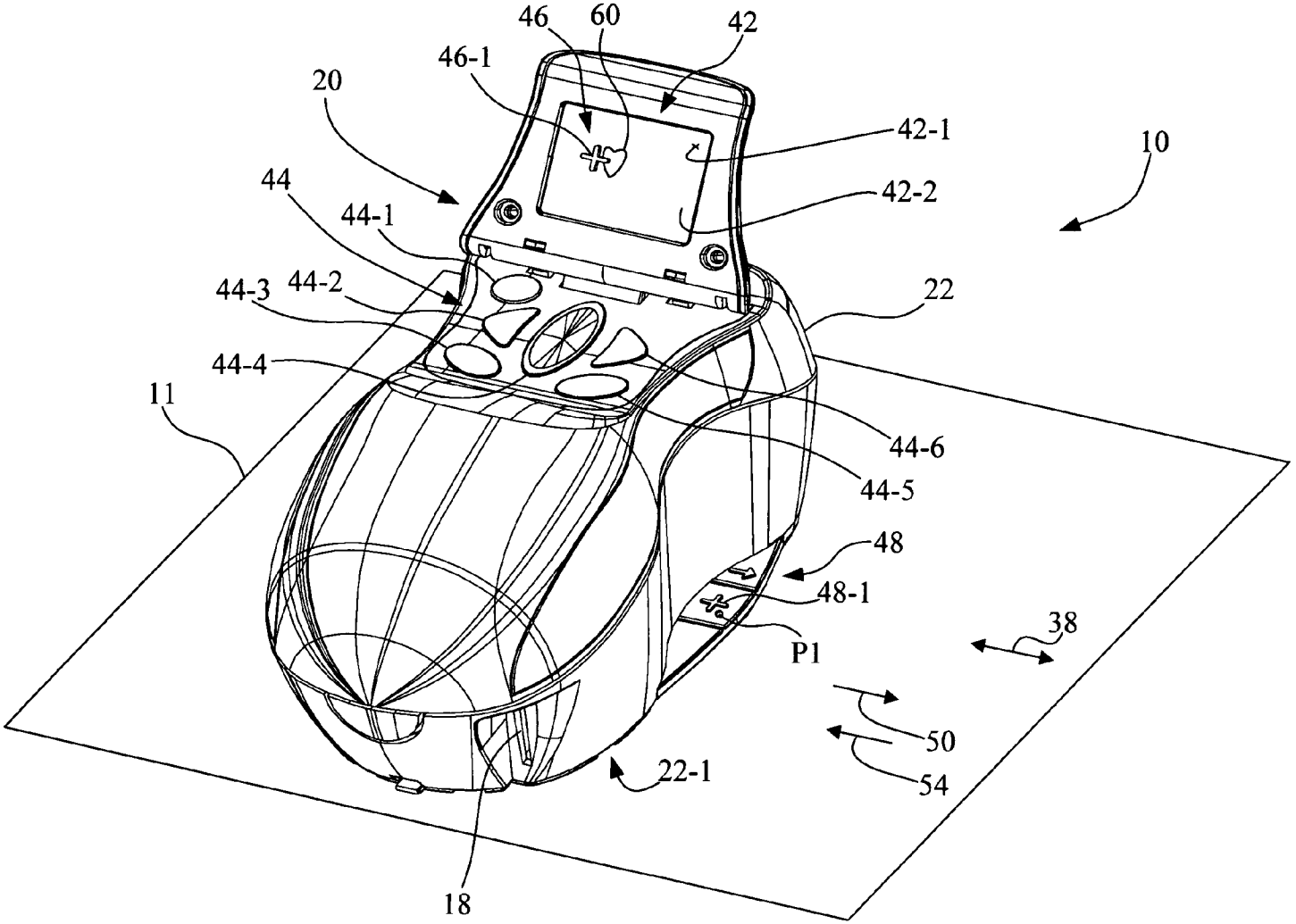
FIG. 2 is a perspective view of the hand-operated printer of FIG. 1.
Figure 3:
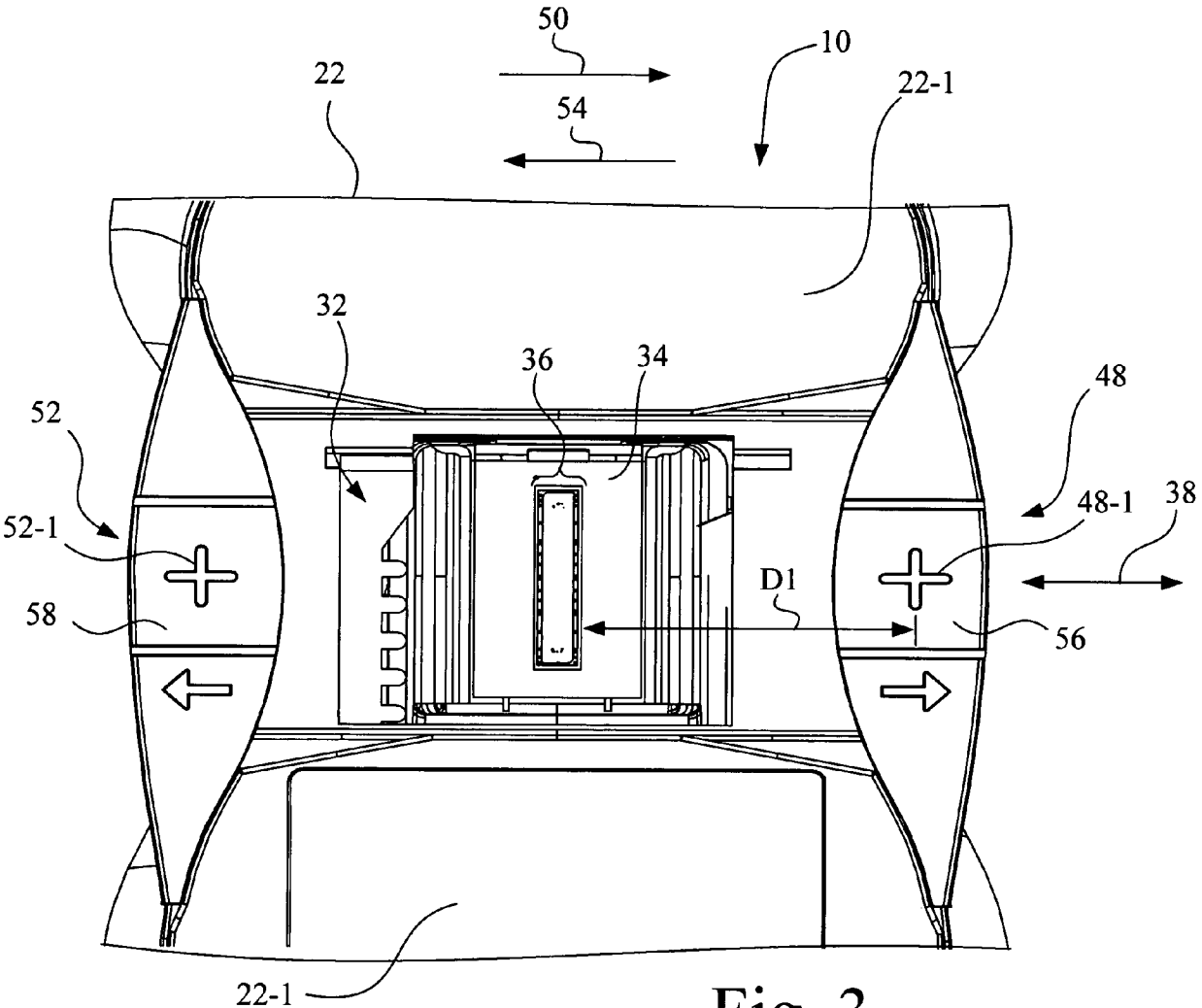
FIG. 3 is a bottom view of an embodiment of the hand-operated printer of FIG. 1.

Referring now to the drawings and particularly to FIG. 1, there is shown a general diagrammatic representation of a hand-operated printer 10 in accordance with an embodiment of the present invention. FIG. 2 is a perspective view of hand-operated printer 10, and FIG. 3 is a bottom view of hand-operated printer 10, flipped over from top to bottom with respect to FIG. 2. As illustrated in FIG. 2, hand-operated printer 10 is configured to be moved along a print medium 11 with a user providing the motive force to provide movement of the hand-operated printer 10 relative to print medium 11, e.g., a sheet of paper, transparency, card stock, fabric, hard surface, soft surface, etc.

Referring to FIG. 1, hand-operated printer 10 may be, for example, a hand-operated ink jet printer, and may include a controller 12, a fixed-position cartridge receptacle 14, a position encoder 16, a memory card reader 18 and a user interface 20. Hand-operated printer 10 also includes a body 22. Each of controller 12, cartridge receptacle 14, position encoder 16, memory card reader 18 and user interface 20 are mounted to body 22 (see FIG. 2). Body 22 is configured with a smooth surface 22-1 that contacts print medium 11.

Controller 12 includes a processor unit and associated memory, and may be formed as one or more Application Specific Integrated Circuits (ASIC). Controller 12 is communicatively coupled to cartridge receptacle 14 via a communications link 24. Controller 12 is communicatively coupled to position encoder 16 via a communications link 26. Controller 12 is communicatively coupled to memory card reader 18 via communications link 28. Controller 12 is communicatively coupled to user interface 20 via communications link 30. As used herein, the term "communications link" generally refers to structure that facilitates electronic communication between components, and may operate using wired or wireless technology.

Cartridge receptacle 14, for example, may be formed in body 22 and configured for receiving and mounting at least one printhead cartridge 32. Cartridge receptacle 14 holds printhead cartridge 32 in a fixed position relative to hand-operated printer 10. Printhead cartridge 32 is communicatively coupled to controller 12 via communications link 24. As shown in the example of FIG. 3, printhead cartridge 32 includes a printhead 34 including an array of ink jetting nozzles 36. Printhead cartridge 32 further includes a supply of ink.

Movement of the hand-operated printer 10 relative to print medium 11 along a scan axis 38 results in relative movement of printhead cartridge 32 and printhead 34 with respect to a printing surface of print medium 11 along scan axis 38. The term "scan axis" is used for convenience, and is intended to include both linear and non-linear movement of hand-operated printer 10. The smooth surface 22-1 of body 22 contacts print medium 11 to provide the desired spacing between printhead 34 and the printing surface of print medium 11.

In the present embodiment of hand-operated printer 10, position encoder 16 may be an optical encoder similar to that used on an optical mouse, and may be configured to only sense movement along scan axis 38. Alternatively, other embodiments of hand-operated printer 10 may include position encoder 16 in other configurations, such as for example, as a rotary encoder coupled to at least one wheel.

Memory card reader 18 is configured to receive a removable memory card 40. Memory card reader 18 and memory card 40 may have a proprietary configuration, or alternatively, may be formed using commercially available components. Memory card 40 may be, for example, in the form of a read-only memory (ROM) card containing a plurality of images generated by a commercial creator. The plurality of images may be, for example, photos, pictures, graphics, symbols, and/or text. Each of the stored images on memory card 40 has associated therewith a distance offset parameter that corresponds to a distance that hand-operated printer 10 will move before printing of the selected image will begin. The distance offset parameter for a particular image may be stored in memory card 40, for example, in an image data header of the image data representing the particular image.

Memory card reader 18 reads the image data stored on memory card 40, and supplies the image data to controller 12 for further routing and/or processing. For example, controller 12 is configured to execute program instructions to facilitate the retrieval of image data from memory card 40, and then format the image data, such as in a full or partial thumbnail view, for display at user interface 20. Also, controller 12 is configured to execute program instructions to format the image data, as necessary, for printing by printhead cartridge 32 when a printing operation is selected by the user via user interface 20.

As best seen in FIGS. 1 and 2, user interface 20 includes a display device 42 coupled by hinges to body 22, and includes a plurality of control buttons 44. Display device 42 and control buttons 44 are communicatively coupled to controller 12 via communications link 30.

Display device 42 may include, for example, a liquid crystal display (LCD) screen 42-1 and a transparent overlay screen 42-2. In the embodiment shown in FIG. 2, transparent overlay screen 42-2 is positioned over LCD screen 42-1. LCD screen 42-1 may have, for example, a resolution (height× width) of 81×101 pixels. Transparent overlay screen 42-2 has formed thereon a representation of a target sight, which for convenience will be referred to herein as target sight representation 46. In this example, target sight representation 46 is in the form of a cross-shaped marker 46-1, e.g., a cross-hair, which will be explained in more detail below.

Target sight representation 46 may be, for example, printed on or etched into transparent overlay screen 42-2. The location of target sight representation 46 on overlay screen 42-2 is correlated with the image displayed on LCD screen 42-1 based on the distance offset parameter associated with the displayed image. Thus, in the example shown in FIGS. 1 and 2, target sight representation 46 may be positioned on overlay screen 42-2 to be offset to the left of center of overlay screen 42-2 to permit viewing of more of the thumbnail image to the right of target sight representation 46 on display device 42. Of course, the actual position of target sight representation 46 may be changed to another location, so long as there is an associated change in the position of the thumbnail image on display device 42. Alternatively, if desired, the target sight representation 46 may be physically formed on LCD screen 42-1, or as a further alternative, generated by software and displayed on LCD screen 42-1 with the image data, in which case the use of transparent overlay screen 42-2 may be avoided.

Control buttons 44 include, for example, a power button 44-1, a scroll-left button 44-2, a repeat button 44-3, a print button 44-4, a maintenance button 44-5 and a scroll-right button 44-6. For example, hand-operated printer 10 is powered-up by pressing power button 44-1. At this time, if memory card 40 is installed in memory card reader 18, a first thumbnail image of the plurality of images stored on memory card 40 is displayed on LCD screen 42-1 of display device 42. The user may then scroll to other images stored on memory card 40 by using scroll buttons 44-2 and/or 44-6. If a user desires to print the currently displayed thumbnail image, then print button 44-4 is pressed and the user moves hand-operated printer 10 relative to print medium 11. If a user desires to repeat the previous operation, repeat button 44-3 is pressed. If the user desires to perform a maintenance operation, e.g., a nozzle purge of ink jetting nozzles 36 of printhead 34, then maintenance button 44-5 is pressed.

In the present embodiment, as shown in FIGS. 2 and 3, a first target sight 48 is positioned to the right of printhead cartridge 32 to facilitate the positioning of a scan of hand-operated printer 10 during scanning in a first scan direction 50, e.g., a left-to-right direction. As shown in FIG. 3, optionally, a second target sight 52 may be positioned to the left of printhead cartridge 32 to facilitate a positioning of a scan of hand-operated printer 10 during scanning in a second scan direction 54, e.g., a right-to-left direction. In the example above, the use of the terms "left-to-right direction" and "right-to-left" assumes that the intended scan path is substantially horizontal. However, those skilled in the art will recognize that the scan path may be of any orientation, e.g., including vertical, diagonal or curved, with respect to the print media.

As best seen in FIG. 3, target sight 48 has a corresponding transparent region 56 formed in body 22, and has a reticle 48-1 providing orientation aspects in two dimensions. In one embodiment, for example, reticle 48-1 may be a cross-shaped reticle providing orientation aspects in perpendicular directions. Target sight 52 has a corresponding transparent region 58 formed in body 22, and has a reticle 52-1 providing orientation aspects in two dimensions. For example, reticle 52-1 also may be a cross-shaped reticle providing orientation aspects in perpendicular directions. Reticles 48-1 and 52-1 are shown substantially vertically centered with respect to the height of printhead 34. However, those skilled in the art will recognize that the vertical and horizontal locations of reticles 48-1 and 52-1 with respect to printhead 34 may be changed, as desired, to accommodate, for example, different maximum swath spacings. For example, reticles 48-1 and 52-1 may be vertically aligned with the upper nozzles, or an upper nozzle section, of printhead 34.

Referring again to FIG. 2, the marker 46-1 of target sight representation 46 corresponds, for example in shape, to reticle 48-1 of target sight 48. For example, an image, such as a thumbnail of an image 60, is displayed on LCD screen 42-1 in relation to marker 46-1 of target sight representation 46 formed on overlay screen 42-2. In the example shown in FIG. 2, image 60 is a picture of a heart that is to be printed left justified with respect to reticle 48-1 of target sight 48. As can be observed from FIG. 3, however, reticle 48-1 of target sight 48 is offset a distance D1 to the right of ink jetting nozzles 36. Accordingly, to accommodate this offset D1, or a similar offset with respect to target sight 52, each image that is stored on memory card 40 includes the above-described distance offset parameter, such as in an image data header of the image data, so that the relation between target sight representation 46 and image 60 that are displayed on display device 42 corresponds to a relationship between the target sight, e.g., reticle 48-1 of target sight 48, and a print position for image 60 on print medium 11.

Various distance offset parameters may be provided in memory card 40 to accommodate a desired amount of left justification, right justification or center justification of the printed image, as desired. Also, the position of the image with respect to each of the left justification or right justification may be shifted by modifying the distance offset parameter for the particular image, and display 42 will reflect this shift by the displayed relation between target sight representation 46 and the displayed image.

In the example shown in FIG. 2, during operation, image 60 is displayed on LCD screen 42-1 left justified with respect to marker 46-1 of target sight representation 46 of overlay screen 42-2. For example, where the heart illustrated as image 60 is to be printed left justified, then the distance offset parameter associated with the image 60 will be an amount that will position image 60 on LCD display 42-1 such that marker 46-1 of target sight representation 46 is displayed to the left of image 60, e.g., to the left of the heart. The user will position hand-operated printer 10 at a desired position, e.g., P1, on print medium 11, as shown in FIG. 2. The user then pushes the print button 44-4, and moves hand-operated printer 10 in scan direction 50. The movement and the direction of movement of hand-operated printer 10 will automatically be sensed by position encoder 16, and printing will commence to begin forming image 60 on print medium 11 after hand-operated printer 10 reaches position P1, i.e., after moving the distance D1 from position P1 corresponding to the distance offset parameter stored in memory card 40 associated with image 60.

Figure 4:
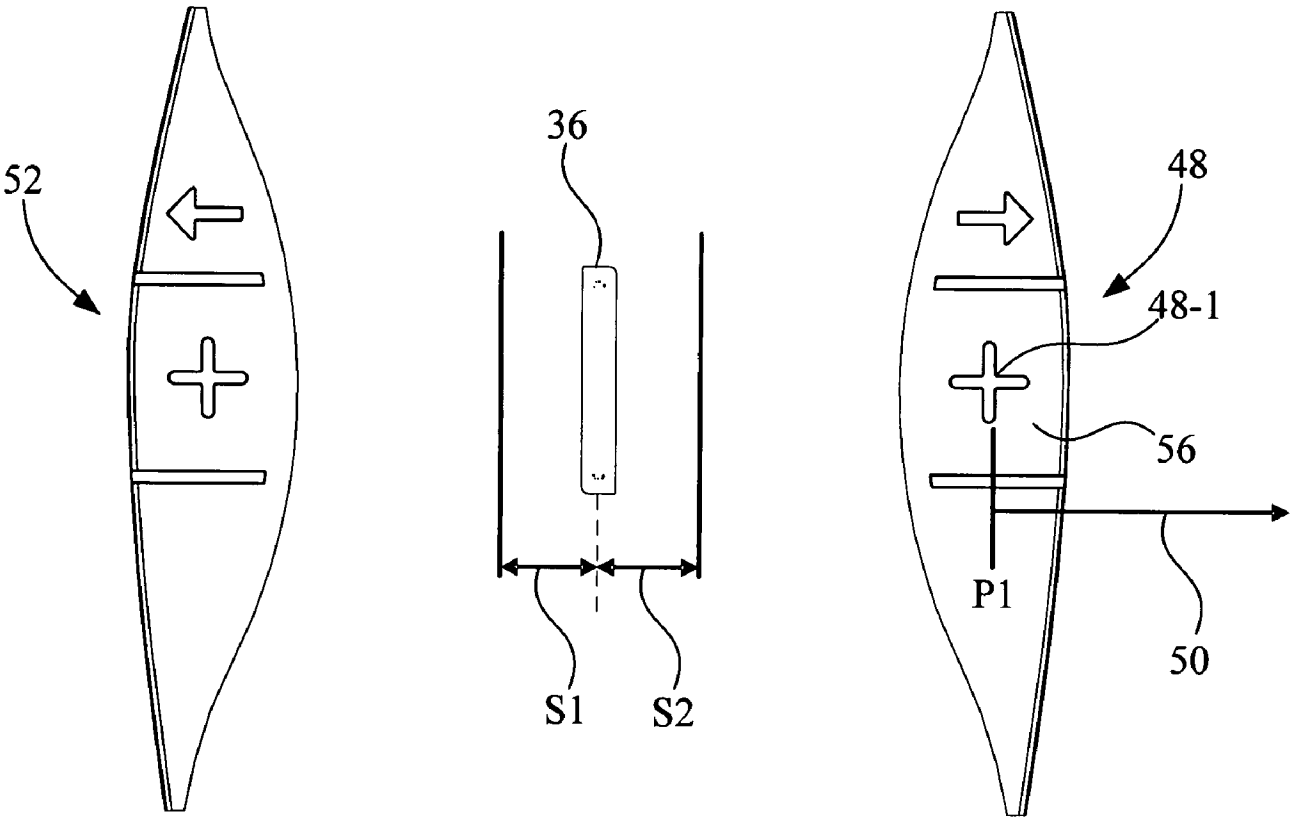
FIG. 4 is a top-down representation of a portion of the hand-operated printer of FIGS. 1-3 illustrating left justified printing from a printhead perspective.

FIG. 4 is a top-down representation of a portion of hand-operated printer 10 illustrating left justified printing from a printhead perspective. As shown in FIG. 4, spaces S1 and S2 are minimum distances reserved on each side of the column of ink jetting nozzles 36 for position encoder 16 to detect the direction of movement of hand-operated printer 10. Position P1 represents the desired print position over which reticle 48-1 of the right of target sight 48 is positioned for left justifying the printed image. There is no limitation on the length of the print swath used in printing image 60 in scan direction 50, from left to right.

Figure 5:
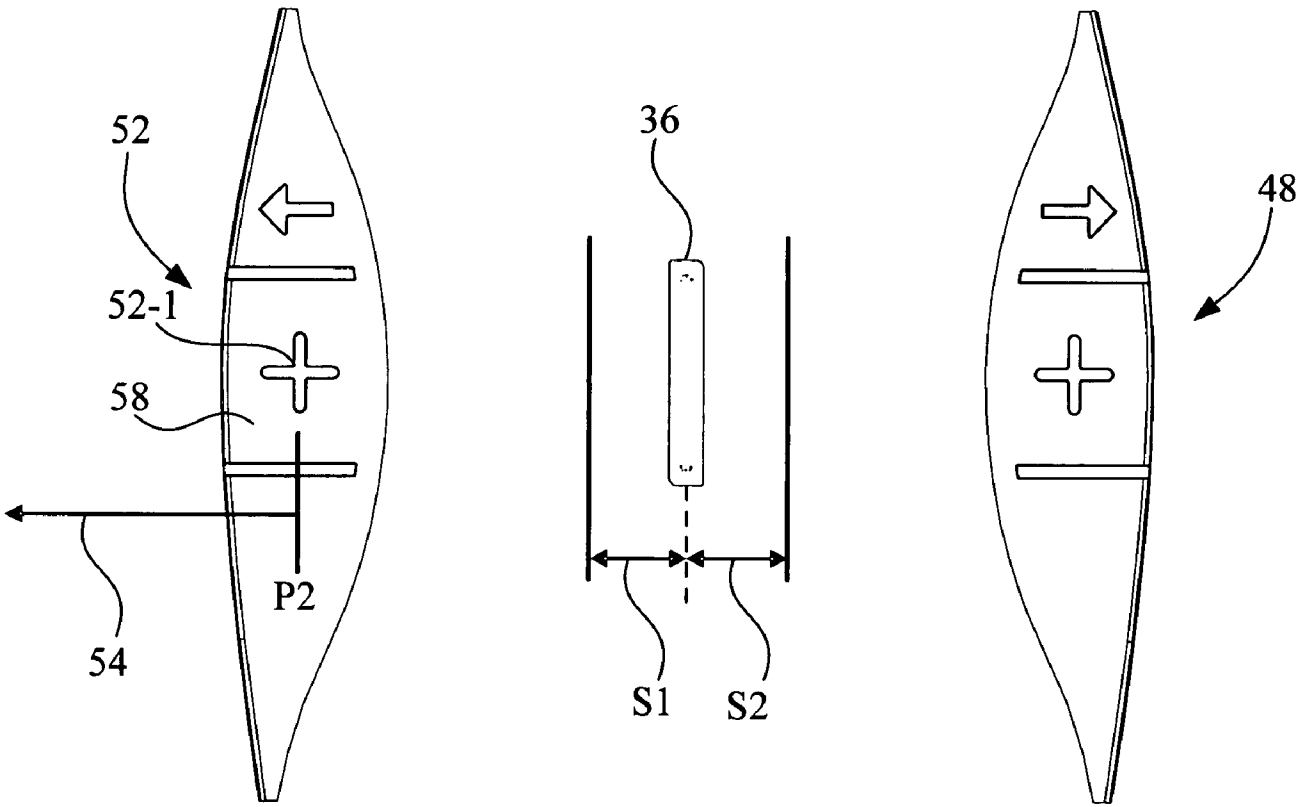
FIG. 5 is a top-down representation of a portion of the hand-operated printer of FIGS. 1-3 illustrating right justified printing from a printhead perspective.

Alternatively, image 60 may be right justified with respect to marker 46-1 of target sight representation 46, and the user will locate reticle 52-1 of the left side target sight 52 at the desired location, e.g., position P2 of FIG. 5, and move hand-operated printer 10 in scan direction 54 by an amount corresponding to the distance offset parameter associated with the image 60 to right justify image 60 with respect to position P2 when printed on print medium 11. Also, for example, if the heart illustrated as image 60 is to be printed right justified, then the distance offset parameter associated with the image 60 will be used to position image 60 on LCD display 42-1 such that marker 46-1 of target sight representation 46 is displayed to the right of image 60, e.g., to the right of the heart.

FIG. 5 is a top-down representation of a portion of hand-operated printer 10 illustrating right justified printing from a printhead perspective. As shown in FIG. 5, again, spaces S1 and S2 are minimum distances reserved on each side of the column of ink jetting nozzles 36 for position encoder 16 to detect the direction of movement of hand-operated printer 10. Position P2 represents the desired print position over which reticle 52-1 of left of target sight 52 is placed for right justifying the printed image. There is no limitation on the length of the print swath used in printing image 60 in scan direction 54, from right to left.

As a further alternative, image 60 may be centered with respect to marker 46-1 of target sight representation 46, and the user may alternatively select either the right side target sight 48 or the left side target sight 52, and select the move direction by moving hand-operated printer 10 in the desired direction, to position the centered image at the desired target sight reference position on print medium 11. Also, for example, if the heart illustrated as image 60 is to be printed center justified, then the distance offset parameter associated with the image 60 will be an amount that will position image 60 on LCD display 42-1 such that marker 46-1 of target sight representation 46 is displayed in the center of image 60, e.g., in the center of the heart.

Figure 6:
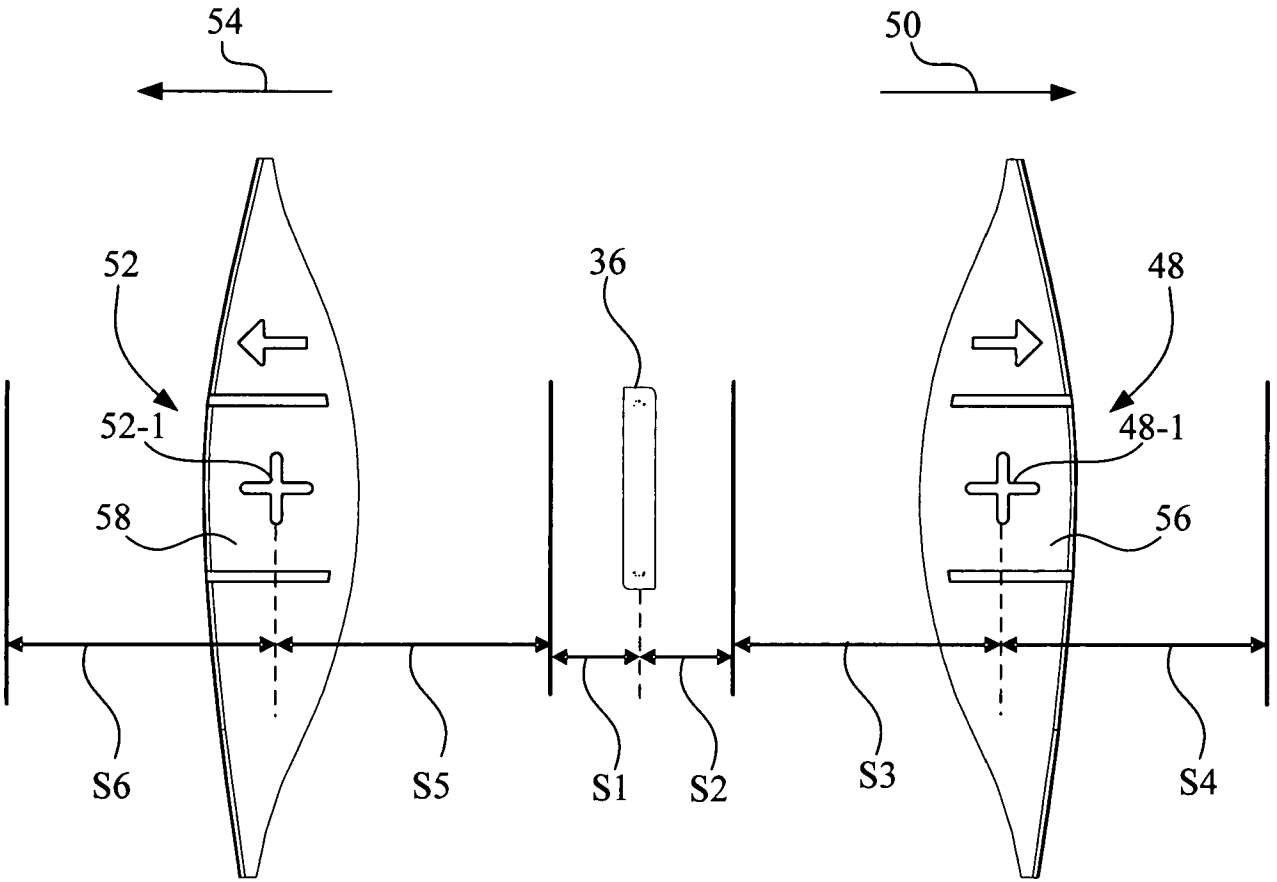
FIG. 6 is a top-down representation of a portion of the hand-operated printer of FIGS. 1-3 illustrating center justified printing from a printhead perspective.

FIG. 6 is a top-down representation of a portion of hand-operated printer 10 illustrating center justified printing from a printhead perspective. As shown in FIG. 6, again, spaces S1 and S2 are minimum distances reserved on each side of the column of ink jetting nozzles 36 for position encoder 16 to detect the direction of movement of hand-operated printer 10. Spaces S3 and S4 are distances that can be used for centering thumbnail image 60, and provide limitations on the image length, when hand-operated printer 10 is moved in scan direction 50, e.g., from left-to-right. Spaces S5 and S6 are distances that can be used for centering thumbnail image 60, and provide limitations on the image length, when hand-operated printer 10 is moved in scan direction 54, e.g., from right-to-left.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hand-operated printer, comprising:

a body;

a printhead mounted to said body;

a target sight mounted to said body; and a display device mounted to said body, said display device being configured to display an image and a representation of said target sight in relation to said image, and wherein said relation between said representation of said target sight and said image that are displayed on said display device corresponds to a relationship between said target sight and a print position for said image.

2. The hand-operated printer of claim 1, wherein said display device includes a LCD screen for displaying said image and an overlay screen positioned over said LCD screen for displaying said representation of said target sight.

3. The hand-operated printer of claim 1, wherein said target sight and said representation of said target sight are of the same shape.

4. The hand-operated printer of claim 1, wherein said target sight has a transparent region formed in said body and a reticle providing orientation aspects in two dimensions.

5. The hand-operated printer of claim 4, wherein said target sight is located on said hand-operated printer to facilitate a positioning of said hand-operated printer with a position on a print medium.

6. The hand-operated printer of claim 4, wherein said target sight facilitates a printing justification of said image with respect to an initial position of said hand-operated printer as said hand-operated printer is moved in a first direction.

7. The hand-operated printer of claim 1, further comprising a plurality of target sights, wherein each target sight of said plurality of target sights has a transparent region formed in said body and a reticle providing orientation aspects in two dimensions.

8. The hand-operated printer of claim 7, wherein said plurality of target sights includes:

a first target sight positioned on said hand-operated printer to facilitate justification of said image in a first direction; and a second target sight positioned on said hand-operated printer to facilitate justification of said image in a second direction opposite to said first direction.

9. The hand-operated printer of claim 7, wherein said plurality of target sights includes a first target sight and a second target sight, said first target sight facilitating center justification when said hand-operated printer is moved in a first direction, and said second target sight facilitating center justification when said hand-operated printer is moved in a second direction opposite to said first direction.

10. The hand-operated printer of claim 1, further comprising:

a memory card reader for receiving a memory card storing a plurality of images; and a controller communicatively coupled to said printhead, said display device, and said memory card reader.

11. The hand-operated printer of claim 10, further comprising a plurality of control buttons communicatively coupled to said controller for operating said hand-operated printer, said plurality of buttons including at least one scroll button for scrolling through said plurality of images.

12. A hand-operated printer, comprising:

a body;

a printhead mounted to said body;

a position encoder mounted to said body;

a target sight mounted to said body;

a memory device mounted to said body, said memory device having stored thereon a plurality of images;

a user interface mounted to said body, said user interface including a display device and a plurality of control buttons, said display device being configured to display an image of said plurality of images and configured to display a representation of said target sight in relation to said image; and a controller communicatively coupled to each of said printhead, said position encoder, said memory device and said user interface, said controller executing program instructions for:

retrieving said image from said memory device; and displaying said image on said display device, wherein said relation between said representation of said target sight and said image that are displayed on said display device corresponds to a relationship between said target sight and a print position for said image on a print medium.

13. The hand-operated printer of claim 12, wherein:

said position encoder automatically senses a movement and a direction of movement of said hand-operated printer; and said controller controls said printhead to print said image on said print medium after said hand-operated printer is moved a predetermined distance to said print position from an initial position where said target sight was initially located on said print medium.

14. The hand-operated printer of claim 12, wherein said display device includes a LCD screen for displaying said image and an overlay screen positioned over said LCD screen for displaying said representation of said target sight.

15. The hand-operated printer of claim 12, wherein said target sight and said representation of said target sight are of the same shape.

16. The hand-operated printer of claim 12, wherein said target sight is located on said hand-operated printer to facilitate a positioning of said hand-operated printer with a position on said print medium.

17. The hand-operated printer of claim 16, wherein said target sight facilitates a printing justification of said image with respect to an initial position of said hand-operated printer as said hand-operated printer is moved in a first direction.

18. The hand-operated printer of claim 12, further comprising a plurality of target sights, wherein each target sight of said plurality of target sights has a transparent region formed in said body and a reticle providing orientation aspects in two dimensions.

19. The hand-operated printer of claim 18, wherein said plurality of target sights includes:

a first target sight positioned on said hand-operated printer to facilitate justification of said image in a first direction; and a second target sight positioned on said hand-operated printer to facilitate justification of said image in a second direction opposite to said first direction.

20. The hand-operated printer of claim 18, wherein said plurality of target sights includes a first target sight and a second target sight, said first target sight facilitating center justification when said hand-operated printer is moved in a first direction, and said second target sight facilitating center justification when said hand-operated printer is moved in a second direction opposite to said first direction.

* * * * *